United States Patent [19]

Burton

[11] 4,124,201

[45] Nov. 7, 1978

[54] KNOCKDOWN SPRING UNIT

[76] Inventor: Robert E. Burton, 2605 W. Strawberry La., Santa Ana, Calif. 92706

[21] Appl. No.: 829,949

[22] Filed: Sep. 1, 1977

[51] Int. Cl.[2] ..... F16F 3/00

[52] U.S. Cl. ..... 267/99; 5/247; 267/102; 267/170; 267/179

[58] Field of Search ..... 267/91, 89, 99, 102, 267/103, 170, 179; 5/247, 255, 259–261, 351

[56] References Cited

U.S. PATENT DOCUMENTS

| | | | |
|---|---|---|---|
| 2,148,961 | 2/1939 | Pleet | 267/91 |
| 2,851,088 | 9/1958 | Pietruszka | 267/102 |
| 3,498,598 | 3/1970 | Rathbun | 267/103 |
| 3,610,607 | 10/1971 | Pofferi | 5/260 |
| 4,003,564 | 1/1977 | Taylor | 5/247 |

*Primary Examiner*—Casmir A. Nunberg

*Attorney, Agent, or Firm*—Clarence A. O'Brien; Harvey B. Jacobson

[57] ABSTRACT

A knockdown spring unit for seating furniture has lift springs connectible to a rail of a frame of the furniture and releasably attachable to a suitable platform arrangement forming a seating surface. The platform arrangement can either be fastened directly to the frame at points opposite connection of the lift springs to the frame, or the platform arrangement can be supported entirely by the lift springs for indirect attachment to the frame. Each of the lift springs has a coil portion which terminates at a one end thereof in an eye and at the other end thereof in a stem disposed extending transversely from the turns of the coil portion and forming a hook provided with a substantially V-shaped bend the vertex of which is normally disposed adjacent the eye of the spring when the spring is in an undeflected state.

18 Claims, 12 Drawing Figures

Fig. 1
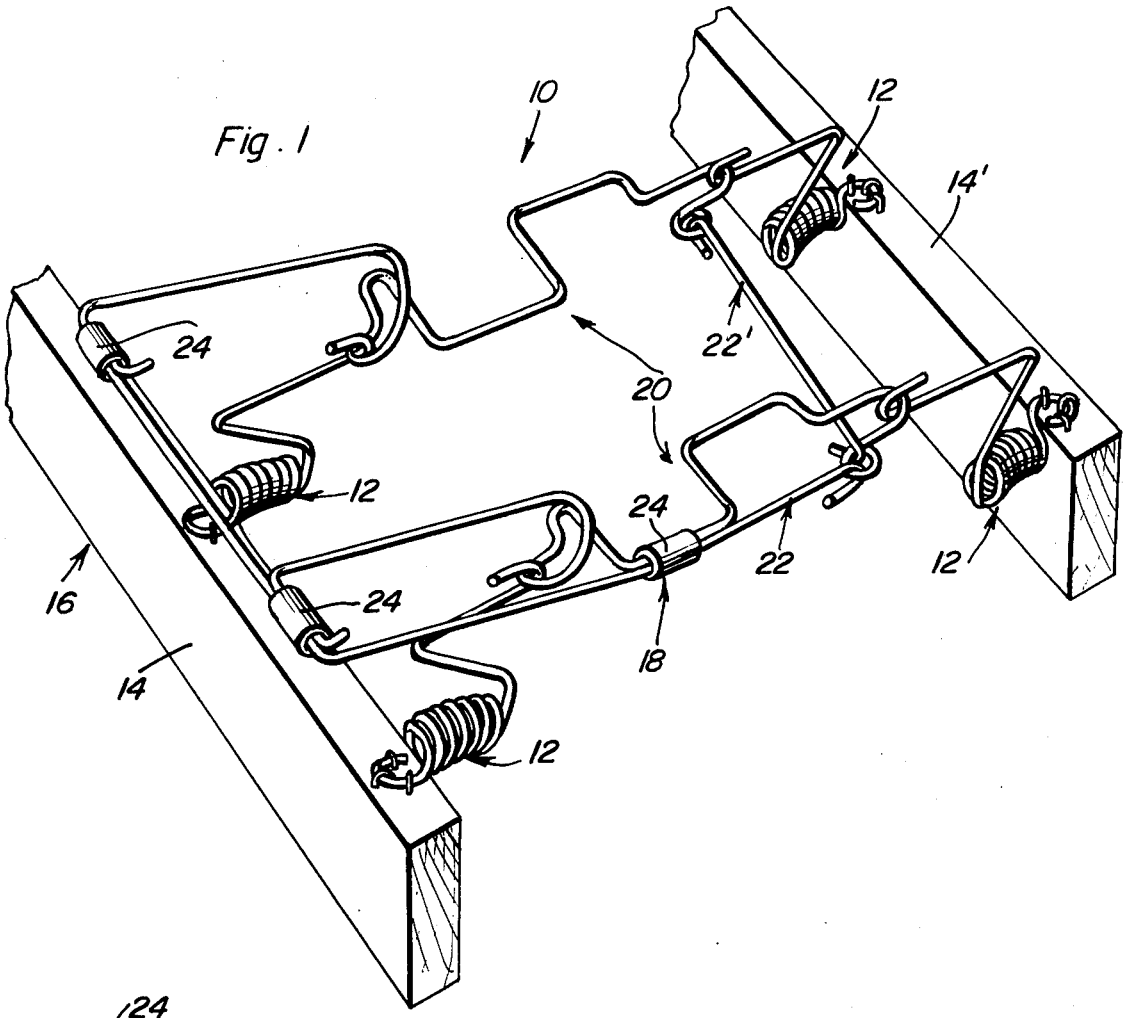
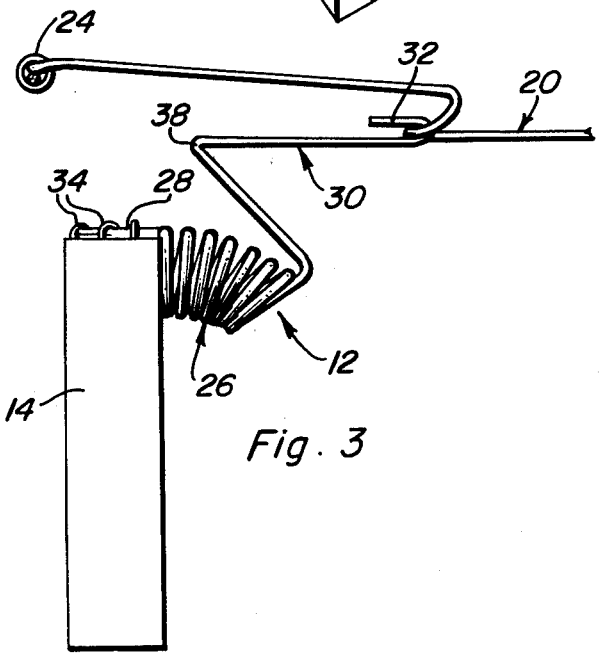
Fig. 3
Fig. 2
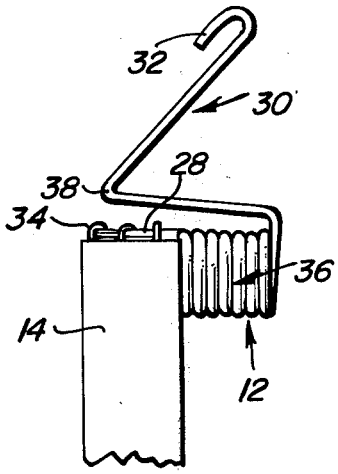

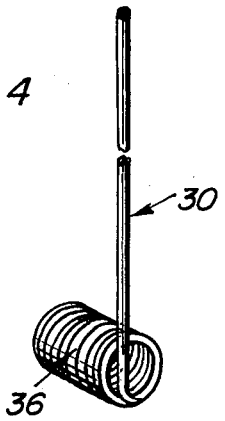
Fig. 4
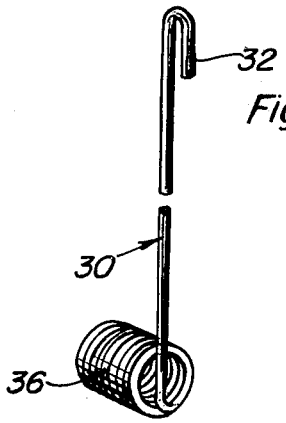
Fig. 5
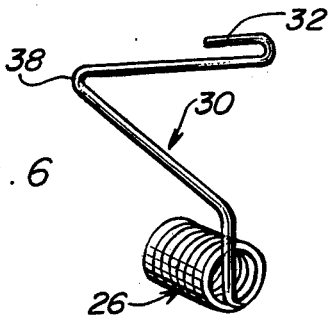
Fig. 6
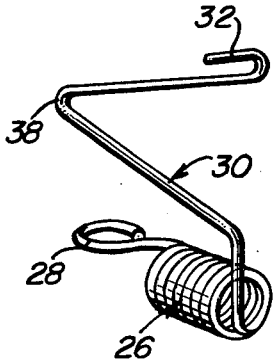
Fig. 7
Fig. 8
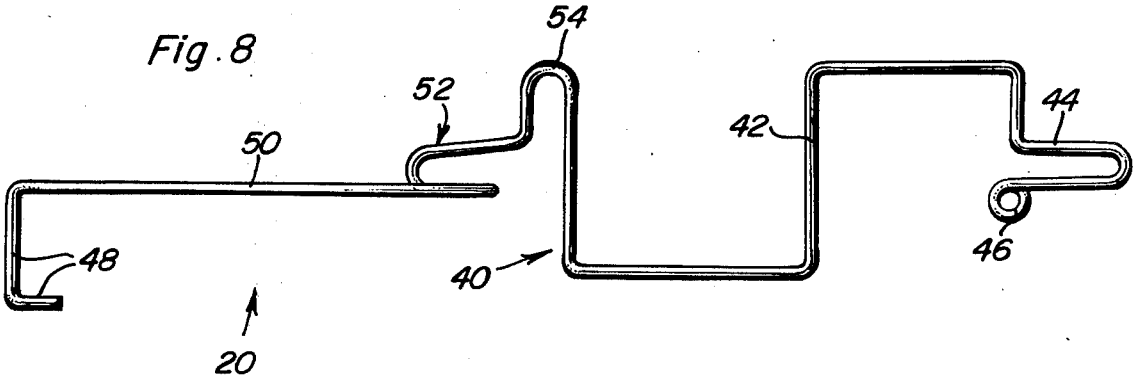
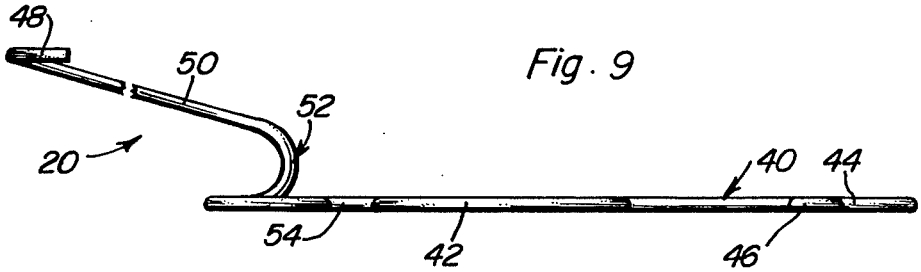
Fig. 9

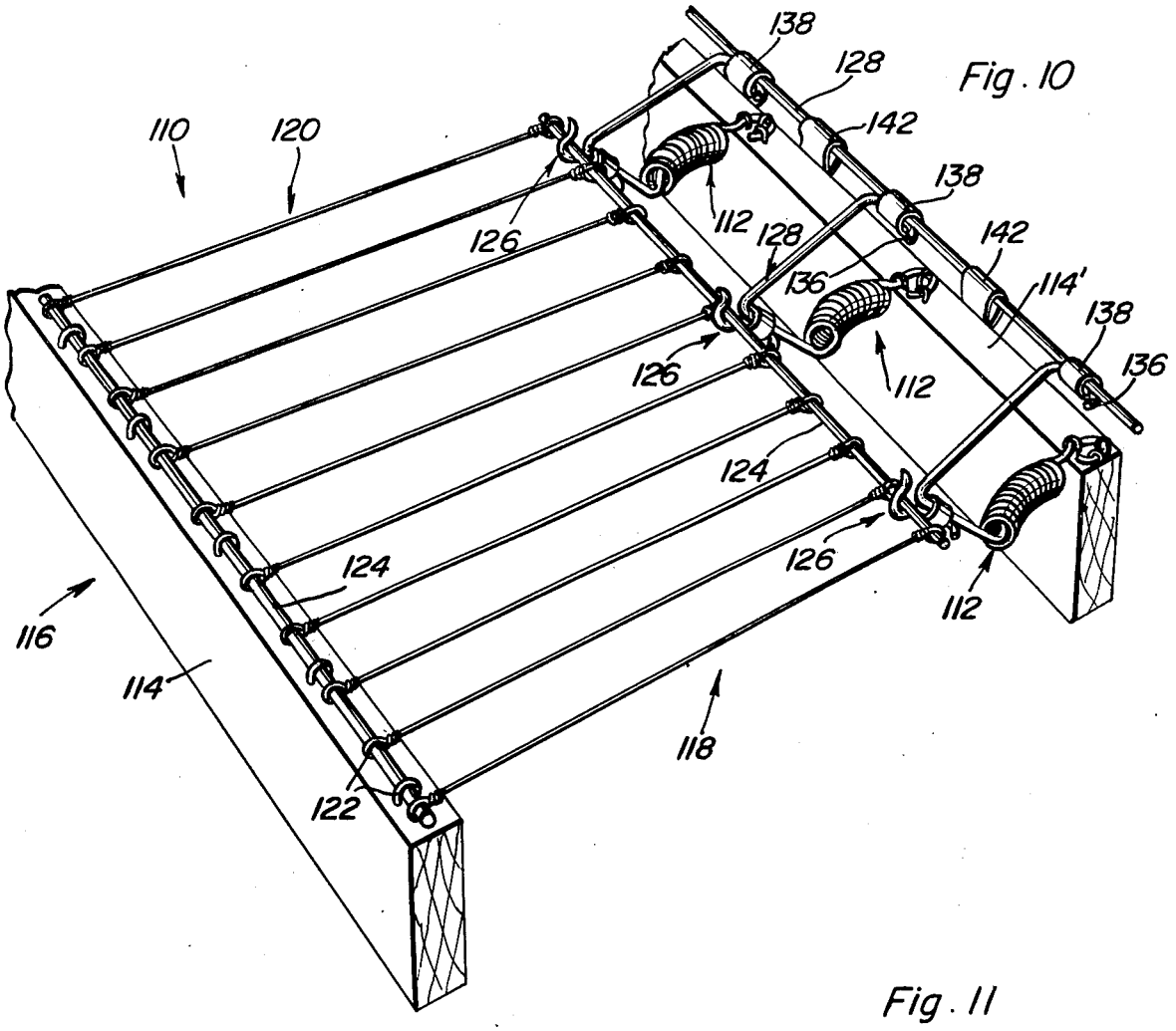
Fig. 10
Fig. 11
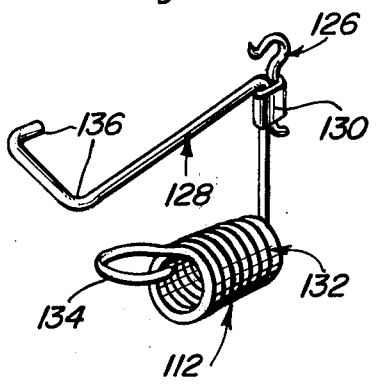
Fig. 12
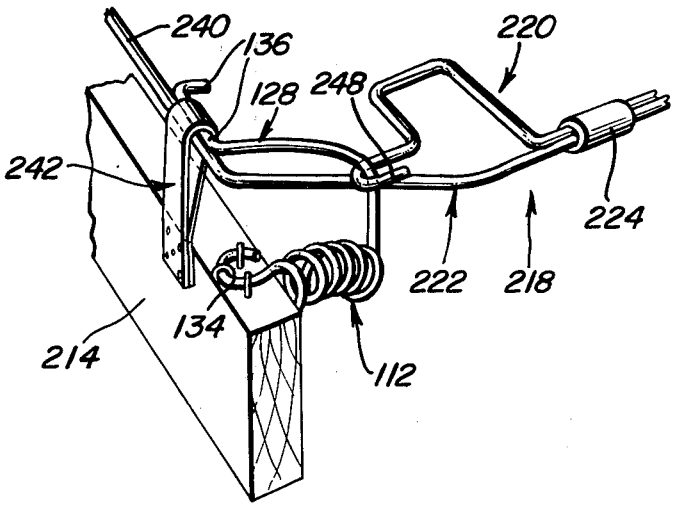

KNOCKDOWN SPRING UNIT

BACKGROUND OF THE INVENTION

1. Field of the Invention

This invention relates generally to a spring assembly used in conjunction with the manufacture of furniture, and particularly to a universal, knockdown spring unit which permits construction of chairs, sofas, and other seating by means of standard parts which can be employed with one another in varying combinations.

2. Description of the Prior Art

A problem encountered in the construction of seating and like furniture having spring assemblies for cushioning the seating surface is that it is difficult to obtain a compact yet stable and uniform spring assembly which has a very sensitive and comfortable feel without encountering expensive constructions that frequently suffer from metal fatigue.

Another disadvantage of known spring structures employed for seating, and the like, is that such structures are required to be manufactured as a complete unit intended for a specific purpose. Thus, the flexibility and versatility of such structures are greatly reduced. Examples of spring structures fabricated as a completed unit for use in seating upholstery can be found in U.S. Pat. Nos. 2,002,157, issued May 21, 1935 to C. S. Reed, and 2,114,918, issued April 19, 1938 to E. F. Engstrom.

U.S. Pat No. 3,497,880, issued March 3, 1970 to E. G. Ott, discloses a spring assembly seating in which the usual border wire is eliminated. While elimination of the border wire has certain advantages, the advantage of such elimination is merely to obtain a simpler, less expensive assembly, and does not necessarily approach the problem of balance, lift and metal fatigue commonly encountered in cushion spring assemblies.

SUMMARY OF THE INVENTION

It is an object of the present invention to provide a knockdown spring unit that can be shipped and stored in pieces and be assembled quickly and efficiently without subjecting the unit to undesirable stresses.

It is another object of the present invention to provide a combination seat deck and soft front edge for sofas provided with cushions.

It is yet another object of the present invention to provide a spring unit for an integral cushion sofa that can be stored in pieces.

It is still another object of the present invention to provide a spring filler for a sofa cushion, and the like.

It is a still further object of the present invention to provide a torsion coil spring for use with cushion spring assemblies which can be used in conjunction with almost any top surface spring or platform to combine spring wire resiliency with leverage in order to eliminate fatigue and give a spring lift to the assembly that is the same as in a more complex and expensive coil spring unit, but at a savings in material, labor and installation time when compared to such units.

These and other objects are achieved according to the present invention by providing a knockdown spring unit having: a lift spring connectible to a rail of a furniture frame; and a platform arrangement releasably attached to the lift spring for forming a seating surface of the frame. The lift spring is a torsion coil spring having two ends which respectively terminate in an eye and in a stem. The stem is disposed extending across and away from the coil portion of the spring, and has a bend provided in the extent thereof. The stem terminates in a hook, with either a vertex of the bend in the stem or the hook being disposed spaced above the eye of the spring. The eye of the spring is attachable to the rail of a frame and is engageable with the platform arrangement in order to at least partially support the platform arrangement on the associated frame.

Although the platform arrangement may assume any suitable form, such as a resilient grill, the present invention provides platform springs each comprising a longitudinally extending element constructed from a resilient material and having a median portion forming a U and extending between two longitudinally spaced ends respectively terminating in a notch and loop and in a bent end, with a shank connecting the bent end to the median portion of the longitudinally extending element. A spiral is formed at a juncture of the shank and the median portion of the element, with the notfch engaging the hook of the lift spring in order to connect the platform spring to the lift spring. The median portion, notch, and loop are disposed in a first plane, while the bent end and shank lie in a second plane arranged at an acute angle of less than 90° with respect to the first plane. The spiral joining the shank and median portion forms a transition between the first plane and the second plane.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view showing a first embodiment of a spring unit according to the present invention.

FIG. 2 is a fragmentary, enlarged, end elevational view showing one of the coil springs seen in FIG. 1, the spring being in an undeflected state.

FIG. 3 is a fragmentary, enlarged, end elevational view, partly in section, showing the front left portion of FIG. 1.

FIGS. 4, 5, 6 and 7 are schematic diagrams showing the sequence of steps employed and forming a torsion coil lift spring according to the present invention.

FIG. 8 is a top plan view showing a platform spring according to the present invention.

FIG. 9 is a fragmentary, side elevational view showing the platform spring of FIG. 8.

FIG. 10 is a fragmentary, perspective view, similar to FIG. 1, but showing a second embodiment of a spring unit according to the present invention.

FIG. 11 is a perspective view showing a second embodiment of a torsion coil lift spring according to the present invention, and as seen in FIG. 10.

FIG. 12 is a fragmentary, enlarged, perspective view showing a third embodiment of a spring unit according to the present invention.

DESCRIPTION OF THE PREFERRED EMBODIMENTS

Referring now more particularly to FIG. 1 of the drawings, a spring unit 10 according to the invention includes a plurality of torsion coil lift springs 12 connected to substantially parallel, opposed rails 14 and 14' of a frame 16 of a suitable seating structure. Releasably attached to the lift springs 12 is a platform arrangement 18 which forms a seating surface associated with frame 16. Arrangement 18 includes a plurality of platform springs 20 according to the present invention, which springs 20 extend between associated pairs of the lift springs 12. Also connected to each of the platform springs 20 is a border wire 22 which is extends substantially parallel to the associated platform spring 20, and a hooking wire 22' which connects together corresponding ones of side-by-side pairs of the lift springs 12. Clips 24, of conventional construction, attach together associated platform springs 20 and border wires 22 both substantially midway between the rails 14 and 14' and at the rail 14.

More specifically, in the arrangement shown in FIG. 1, the lift springs 12 are mounted to the front and back rails 14 and 14' by the illustrated staples or other known fasteners, are hooked into the platform surface forming springs 20 in such a manner as to put a balanced leverage load on the springs 12 by opening the upper coils of springs 12 with closing pressure on the lower turns or coils of springs 12 in order to create lifting power determined by the load on the springs, and the border wire 32 is connected to the front of each adjacent platform spring 20 by the clips 24, then bent in a right angle and clipped to the side if outermost of the platform springs 20, one of which springs being the lowermost spring 20 in FIG. 1. The border wire 22 is then hooked onto the back of the outermost platform springs 20. In addition, the hooking wire 22' is linked or seated into appropriately provided loops of the lift springs 12 in order to stabilize springs 12 across the back, or adjacent rail 14', of frame 16 so as to provide a complete spring assembly which eliminates metal fatigue and has a very sensitive spring comfort.

Referring now more particularly to FIGS. 2 and 3 of the drawings, each of the lift springs 12 includes a coil portion 26 having two ends respectively terminating in an eye 28 and a stem 30. The latter is disposed extending across an end of and away from, or laterally of, coil portion 26, has a bend provided in the extent thereof, and terminates in a hook 32. Eye 28 is attachable to a rail 14, 14' of frame 16 as by the illustrated staples 34, while hook 32 is removably engageable with the platform springs 20 or other suitable structure employed as platform arrangement 18.

Coil portion 26 includes a helix 36 formed by a plurality of turns of spring wire, and the like, with stem 30 being disposed extending substantially diametrically across an adjacent end of one of the turns of helix 36. In this manner, stem 30 will extend in a plane substantially parallel to the longitudinal axis of the helix 36 forming coil portion 26.

The bend formed in stem 30 of each lift spring 12 is substantially in the shape of a V having a vertex disposed adjacent the eye 28 of the spring 12 when the coil portion 26 is in an undeflected, rest position or state as seen in FIG. 2.

As can be seen from FIGS. 4–7 of the drawings, a spring 12 is constructed by coiling a length of suitable spring wire and bending stem 30 upwardly as seen in FIG. 4. Hook 32 is then formed at the end of the wire stem 30 as seen in FIG. 5, and stem 30 is bent at a predetermined desired angle depending on spring load lift desired as seen in FIG. 6. Lastly, the other end of the coil portion 26 of spring 12 is bent so as to form the mounting eye 28. In this simple manner, therefore, a lift spring is formed which forms the basis for a spring unit incorporating any suitable structure as a platform arrangement 18.

Each platform spring 20 is shown in FIGS. 8 and 9 as including a longitudinally extending element constructed from a suitable resilient material, such as conventional spring wire, and having a median portion 40 forming a U-shaped section 42 and having two longitudinally spaced ends respectively terminating in a notch 44 and loop 46 and in a bent end 48. A shank 50 connects bent end 48 to median portion 40,, with a spiral 52 being formed at a juncture of shank 50 and median portion 40 of the element forming platform spring 20. Notch 44 is arranged for engaging with hook 32 of an associated spring 12 when a spring unit 10 is assembled and shown in FIG. 1.

As can be seen from FIG. 9, median portion 40, notch 44, and loop 46 are disposed in a first plane and bent end 48 an its associated shank 50 lie in a second plane arranged in an acute angle of less than 90° with respect to the first plane. Spiral 52 is disposed adjacent a recess 54 partially forming section 42 and generally arranged so as to form a transition between the first plane and second plane of spring 20. As can be seen from FIGS. 1 and 3, the angle between the two planes of each spring 20 permits attachment of the springs 20 to associated lift springs 12 and to the border wire 22.

As can be seen from FIG. 8, shank 50 and loop 46 lie substantially in a common plane.

In operation, the spring unit 10 set forth in FIG. 1 will act under load as shown in FIG. 3. The spacing between the coils or turns of the spring portion 26 disposed uppermost will increase, or the uppermost portions of the turns will open, and the lowermost portions of the turns will abut one another, or will close, with great pressure against each other forming a balance power to eliminate metal fatigue and provide assistance to the memory of the spring steel from which the springs 12 are constructed.

Referring now to FIGS. 10 and 11 of the drawings, a spring unit 110 is illustrated as including lift springs 112 connected to rail 114 of a frame 116. Attached to the lift springs 112 and to the front rail 114, with rail 114' being the back rail, is a platform arrangement 118 in the form of a flexible grill 120. Conventional staples 122, which may be applied by an air gun (not shown) and the like, attach rod 124 of grill 120 to rail 114, while rod 124' of grill 120 is connected to the lift springs 112. The later may be attached to the rail 114' in a suitable manner, such as by the illustrated staples which may be similar to staples 122 and applied in the same manner.

It is to be understood that although a flexible grill 120 is shown as forming platform arrangement 118, any suitable flexible seating support, such as a sheet of suitable material, may be employed, and that the platform arrangement 118 may be constructed from any suitable material, including metals, synthetic resins, fabrics, and the like. When the flexible grill 120 is hooked onto the lift springs 112, which will generally require force by the installer (not shown), the resulting spring unit 110 will provide a very comfortable seating structure at an economical price.

Rod 124' is advantageously attached to the lift springs 112 as by the hangers 126 having hook portions extending from a shank retained on stem 128 of a respective spring 112 by a suitable clip 130. As can be seen from FIG. 11, the stem 128 extends substantially vertically from the coil portion 132 of spring 112 and then extends substantially longitudinally of the coil portion 132 to a point immediately above and beyond, but spaced from, the eye 134 of spring 112 so as to terminate in the hook 136 which projects substantially transversely from stem 128 so as to be received by a clip 138.

Clips 138 attach the hooks 136 of springs 112 to a edge wire 140 which runs along the upper and outer edge of rail 114', while flexible straps 142 holds the edge wire 140 straight with respect to the rail 114 during upholstering. These straps 142 may be constructed from any suitable material, such as a conventional fabric.

FIG. 12 shows how the lift springs 112 may be employed with a front rail 214 when the platform arrangement 218 is formed by a plurality of platform springs 220 and border wire 222 attached to one another by a clip 224 in the manner of platform springs 20, border wire 22, and clips 24 of the embodiment set forth in FIG. 1. Thus, the use of lift springs 112 provided with their hooks 136 permits a front soft edge to be formed in the resulting upholstered cushion. The border wire 222, or an edge wire not shown but equivalent to edge wire 140, is disposed so as to form a resilient front edge of the spring assembly which permits the front soft edge of the resulting structure to be formed. The flexible straps 242, equivalent to straps 142, maintain proper alignment of the border wire 222, or equivalent wire when such is used on the front rail 224.

Platform spring 220 is constructed so that the opposite end thereof may be substantially identical to the end shown in FIG. 12 in order to provide a symmetrical platform arrangement for the spring unit.

As can be readily understood from the above description and from the drawings, a spring unit built around a torsion coil lift spring 12, 112 according to the present invention permits a spring unit to be assembled employing almost any top surface spring or platform, and the resulting unit will combine spring wire resiliency with leverage to eliminate fatigue. Further, a spring unit according to the present invention will provide spring lift that is the same as in more complex and expensive coil spring units, but at a savings in materials, labor, and installation time.

These, together with other objects and advantages which will become subsequently apparent, reside in the details of construction and operation as more fully hereinafter described and claimed, reference being had to the accompanying drawings forming a part hereof, wherein like numerals refer to like parts throughout.

What is claimed as new is as follows:

1. A knockdown spring unit, comprising, in combination:

(a) a lift spring connectible to a rail of a furniture frame; and (b) platform means releasably connected to the lift spring for forming a seating surface of the frame, the lift spring including a coil portion having two ends respectively terminating in an eye disposed adjacent the coil portion and a stem, the stem being disposed extending across and transversely away from the coil portion, the stem having a bend provided in the extent thereof, and the stem terminating in a hook with the eye being attachable to the rail of the frame and the hook being engageable with the platform means.

2. A structure as defined in claim 1, wherein the coil portion includes a helix formed by a plurality of turns of a spring wire, with the stem being disposed extending from the helix substantially diametrically across an adjacent end one of the turns.

3. A structure as defined in claim 1, wherein the bend provided in the stem is substantially in the shape of a V having a vertex disposed adjacent the eye when the coil portion is in an undeflected, rest position.

4. A structure as defined in claim 1, wherein the bend provided in the stem forms an angle of substantially 90° and the hook terminating the stem is disposed spaced from but substantially opposite the eye of the spring.

5. A structure as defined in claim 1, wherein the platform means is a flexible grill.

6. A knockdown spring unit, comprising, in combination:

(a) a lift spring connectible to a rail of a furniture frame; and (b) platform means releasably connected to the lift spring for forming a seating surface of the frame, the lift spring including a coil portion having two ends respectively terminating in an eye and a stem, the stem being disposed exposed extending across and transversely away from the coil portion, the stem having a bend provided in the extent thereof, and the stem terminating in a hook with the eye being attachable to the rail of the frame and the hook being engageable with the platform means, the platform means including a platform spring comprising a longitudinally extending element constructed from a resilient material and having a median portion forming a U and extending between two longitudinally spaced ends respectively terminating in a notch and loop and in a bent end, a shank connected to the bent end and to the median portion with a spiral being formed at a juncture of the shank and the median portion of the element, the notch engaging the hook of an associated lift spring for removably attaching the platformm spring to the lift spring.

7. A structure as defined in claim 6, wherein the median portion, notch, and loop are disclosed in a first plane, and the bent end and shank are disposed in a second plane arranged at an acute angle of less than 90° with respect to the first plant, with the spiral forming a transition between the first plane and the second plane.

8. A structure as defined in claim 7, wherein there are a plurality of lift springs and platform springs, each of the lift springs being connected to a respective one of the platform springs and an associated rail of the frame.

9. A structure as defined in claim 1, wherein the platform means includes a platform spring comprising a longitudinally extending element constructed from a resilient material and having a median portion forming a V and extending between two longitudinally spaced ends respectively terminating in a notch and loop and in a bent end, a shank connected to the bent end and to the median portion, with a spiral being formed at a juncture of the shank and the median portion of the element.

10. A structure as defined in claim 9, wherein the median portion, notch, and loop are disclosed in a first plane, and the bent end and shank are disposed in a second plane arranged at an acute angle of less than 90° with respect to the first plane, with the spiral forming a transition between the first plane and the second plane.

11. A structure as defined in claim 10, wherein there are a plurality of lift springs and platform springs, each of the lift springs being connected to a respective one of the platform springs and an associated rail of the frame.

12. A lift spring for a knockdown spring unit, comprising a coil portion having two ends respectively terminating in an eye and a stem, the stem extending substantially vertically of the coil portion of the spring and the stem having a bend provided in the extent thereof and extending substantially longitudinally of the coil portion to a terminal hook which projects substantially transversely from the stem so as to enngage a platform member, with the eye being attachable to a rail of a frame, the coil portion including a helix formed by a plurality of turns of a spring wire, with the stem being disposed extending from the helix substantially diametrically across an adjacent end one of the turns.

13. A structure as defined in claim 14, wherein the bend provided in the stem forms an angle of substantial degrees and the hook terminates the stem substantially beyond and directly above the eye of the spring.

14. A structure as defined in claim 14, wherein the bend provided in the stem forms an angle of substantial degrees, and the hook which terminates the stem extending substantially beyond and above the eye of the spring, such that with engagement of the platform the deflection of the uppermost coils of the lift spring will increase, and the lowermost portion of the coils will abut one another.

15. A lift spring for a knockdown spring unit, comprising a coil portion having two ends respectively terminating in an eye and a stem, the stem extending substantially vertically of the coil portion of the spring and the stem extending substantially longitudinally of the coil portion to a point immediately above and beyond, but spaced from, the eye of the spring so as to terminate in a hook which projects substantially transversely from the stem so as to be received by a fastener, a hook portion extending from a clip retained to a median portion of the stem for engagement with a platform, with the eye being attachable to a rail of a frame, the stem extending substantially beyond the eye when engaged with the platform, the stem terminating immediately above the eye and flush to the frame to form a soft edge, the bend provided in the stem forming an angle so desired and the stem terminating substantially beyond and directly as desired above the eye of the spring, accrediting to the softness or firmness of the soft edge.

16. A structure as defined in claim 14, wherein the bend provided in the stem forms an angle so desired and the hook terminating the stem being substantially beyond and directly as desired above the eye of the spring, accrediting to the spring unit lift desired, softer or firmer.

17. A structure as defined in claim 15, in combination with the platform, the platform comprising a flexible grill.

18. A structure as defined in claim 12, in combination with the platform, the platform comprising a flexible grill.

* * * * *